US008631726B2

(12) United States Patent
Ehlers et al.

(10) Patent No.: US 8,631,726 B2
(45) Date of Patent: Jan. 21, 2014

(54) TORQUE LIMITING ENGINE ROTATION TOOL

(75) Inventors: Mark Ehlers, Fort Wayne, IN (US); Karl Reith, Auburn, IN (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 380 days.

(21) Appl. No.: 13/080,147

(22) Filed: Apr. 5, 2011

(65) Prior Publication Data

US 2012/0255403 A1 Oct. 11, 2012

(51) Int. Cl.

| | |
|---|---|
| ***B25B 23/14*** | (2006.01) |
| ***B25B 23/153*** | (2006.01) |
| ***B25B 23/159*** | (2006.01) |
| ***B25B 23/16*** | (2006.01) |
| ***B25G 1/00*** | (2006.01) |

(52) U.S. Cl.
USPC ..... 81/467; 81/477; 81/471; 81/177.85

(58) Field of Classification Search
USPC ..... 81/467, 477, 471, 177.85
See application file for complete search history.

(56) References Cited

U.S. PATENT DOCUMENTS

| | | | | | |
|---|---|---|---|---|---|
| 1,778,477 | A | * | 10/1930 | Wood | 464/33 |
| 3,031,218 | A | * | 4/1962 | Ellis | 403/164 |
| 3,395,588 | A | | 8/1968 | Bleigh | |
| 3,753,625 | A | * | 8/1973 | Fabrizio et al. | 408/239 R |
| 3,830,119 | A | * | 8/1974 | Travis | 81/477 |
| 4,580,534 | A | | 4/1986 | Blum | |
| 4,703,677 | A | * | 11/1987 | Rossini | 81/471 |
| 4,875,528 | A | * | 10/1989 | Thackston | 173/178 |
| 5,299,474 | A | * | 4/1994 | Hohmann et al. | 81/471 |
| 5,460,138 | A | | 10/1995 | Hasegawa | |
| 5,882,181 | A | | 3/1999 | Genter | |
| 5,997,260 | A | | 12/1999 | Genter | |
| 6,904,886 | B2 | | 6/2005 | Capodiferro | |

* cited by examiner

*Primary Examiner* — Monica Carter
*Assistant Examiner* — Danny Hong
(74) *Attorney, Agent, or Firm* — Jeffrey P. Calfa; Mark C. Bach

(57) ABSTRACT

A torque limiting engine rotation tool for rotating a crankshaft of an engine, where the engine rotation tool is configured to be operated with a socket wrench or non-impacting tool and is configured to engage an accessory drive pulley bolt or any other bolt that causes the crankshaft to rotate, includes a socket body. The socket body has a driving portion coupled to a bolt-torquing portion with a shear pin. A receiving recess is defined by the driving portion and is configured to receive the socket wrench or non-impacting tool. A female socket recess is defined by the bolt-torquing portion and is configured to engage the bolt. The amount of torque applied by the socket wrench or non-impacting tool to the bolt is limited by the shear strength of the shear pin.

21 Claims, 3 Drawing Sheets

TORQUE LIMITING ENGINE ROTATION TOOL

BACKGROUND

Embodiments described herein relate generally to engines, and more particularly, to an engine rotation tool for rotating a crankshaft of an engine.

Repair and general maintenance of engines often involves the rotation of the crankshaft so that it is positioned in a particular way with respect to other engine components. Many engine components are actuated by the crankshaft, so the repair and maintenance of the engine components is often accomplished by rotating the crankshaft to bring the parts into a particular position. The manual rotation of the engine crankshaft is also called "engine barring." Typically, a technician manually rotates the crankshaft by rotating an accessory drive pulley driven by a crankshaft pulley.

The technician rotates an accessory drive pulley bolt or crankshaft pulley bolt to rotate the crankshaft. Care is taken by the technician to avoid over-torquing or loosening of the accessory drive pulley bolt. However, sometimes the technician inadvertently over-torques or loosens the accessory drive pulley bolt or crankshaft bolt, resulting in damage to the engine. To avoid over-torquing of the accessory drive pulley bolt, a technician may opt to rotate the crankshaft at a different point on the engine, where this different point may be harder to access as compared to the accessory drive pulley bolt.

SUMMARY

A torque limiting engine rotation tool for rotating a crankshaft of an engine, where the engine rotation tool is configured to be operated with a socket wrench or other non-impacting tool and is configured to engage an accessory drive pulley bolt or any other bolt that will cause the crankshaft to rotate, includes a socket body. The socket body has a driving portion coupled to a bolt-torquing portion with a shear pin. A receiving recess is defined by the driving portion and is configured to receive the socket wrench or non-impacting tool. A female socket recess is defined by the bolt-torquing portion and is configured to engage the bolt. The amount of torque applied by the socket wrench or non-impacting tool to the bolt through the socket body is limited by the shear strength of the shear pin.

Another torque limiting engine rotation tool for rotating a crankshaft of an engine, where the engine rotation tool is configured to be operated with a socket wrench or non-impacting tool and to engage an accessory drive pulley bolt or any other bolt that will cause the crankshaft to rotate, includes a socket body. The socket body has a driving portion engaged with a bolt-torquing portion. The socket body defines a longitudinal axis. A receiving recess is defined by the driving portion and is configured to receive the socket wrench or non-impacting tool. A shear pin is disposed generally perpendicular to the longitudinal axis and extends through the driving portion and the bolt-torquing portion. A female socket recess is defined by the bolt-torquing portion and is configured to engage the bolt. When torque is applied by the socket wrench to the driving portion of the socket body, the shear pin transmits the torque from the driving portion to the bolt-torquing portion. When the shear pin fails, torque is not transmitted from the driving portion to the bolt-torquing portion.

A method of rotating a crankshaft of an engine with a socket wrench or non-impacting tool and a torque limiting engine rotation tool that engages an accessory drive pulley bolt or other bolt that will cause the crankshaft to rotate includes the step of engaging a socket body with the bolt at a female socket recess of the socket body. The method also includes the step of engaging the socket wrench or non-impacting tool with a receiving recess of the socket body, and applying torque to the socket body with the socket wrench or non-impacting tool. The method further includes the step of limiting the torque applied from the socket body to the bolt by the shear strength of a shear pin disposed in the socket body.

As described above, the Torque Limiting Engine Rotation Tool provides a number of advantages, some of which have been described above and others of which are inherent. Also, modifications may be proposed to the Torque Limiting Engine Rotation Tool without departing from the teachings herein.

DETAILED DESCRIPTION

Figure 1:
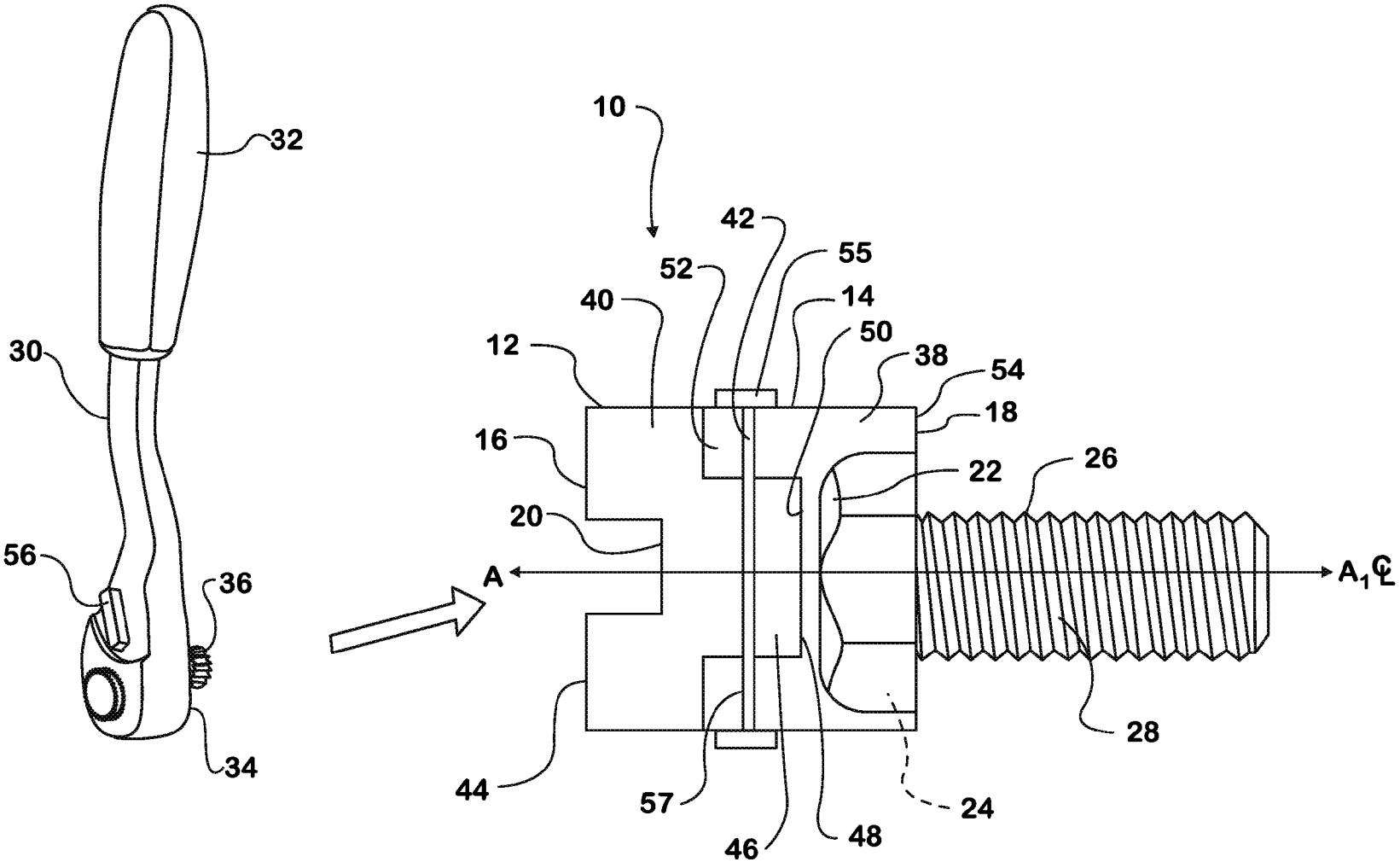
FIG. 1 is a schematic cross-section of a torque limiting engine rotation tool.
Figure 3:
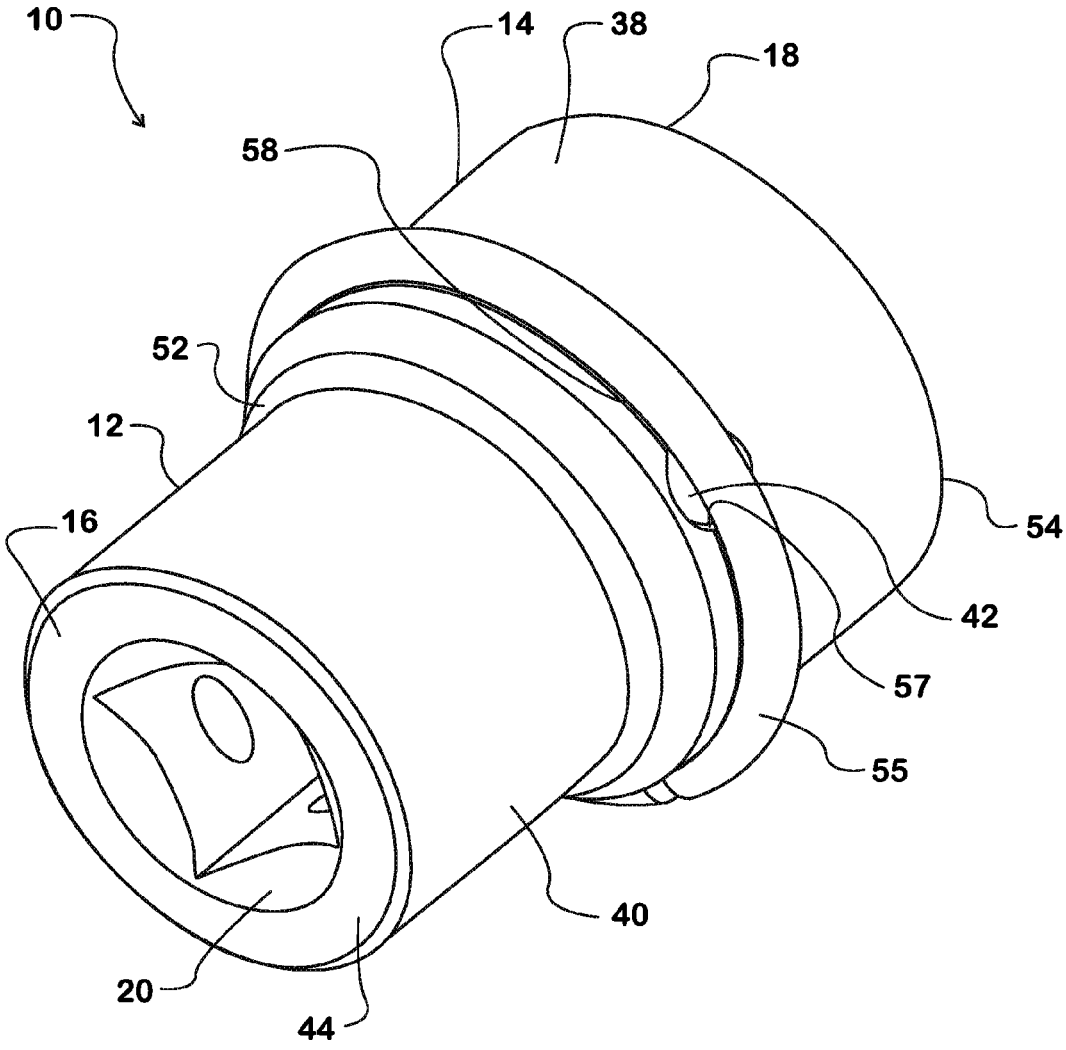
FIG. 3 is a perspective view of the first embodiment of the torque limiting engine rotation tool.

Referring to FIG. 1 and FIG. 3, a torque limiting engine rotation tool is indicated generally at 10, and will hereafter be referred to as the "engine rotation tool". The engine rotation tool 10 may be used to rotate the crankshaft of an engine (not shown), however other applications of the tool are possible.

The engine rotation tool 10 has a socket body 12 that is generally cylindrical shaped. The socket body 12 has a longitudinal axis A, an exterior surface 14 generally parallel with the longitudinal axis A, and a first end 16 and a second end 18 opposite of the first end. The first end 16 and the second end 18 are generally perpendicular to the axis A. While the exterior surface 14 is shown generally parallel to the axis A in FIG. 1, it is possible that the exterior surface may be curved or irregular-shaped, such as in FIG. 3.

A receiving recess 20 is generally disposed on axis A on the first end 16 of the socket body 12, and a female socket recess 22 is generally disposed on the axis A on the second end 18 of the socket body. The female socket recess 22 is configured to grip a head 24 of a bolt 26 to apply torque to the bolt. The female socket recess 22 may be indexed for various sizes of heads 24 of bolts 26. While the female socket recess 22 of the engine rotation tool 10 is configured to receive an accessory drive pulley center bolt 26, it is possible that the engine rotation tool can be used on other bolts and fasteners, including bolts and fasteners not associated with engines. The longitudinal axis A is generally coaxial with the centerline CL of the accessory drive pulley bolt 26 as defined by a shaft 28 of the bolt.

The receiving recess 20 of the engine rotation tool 10 is configured to receive a socket wrench handle 30 having a hand-receiving portion 32 and a socket head 34. A generally rectangular prismatic protrusion 36 extends from the socket head 34 and engages the receiving recess 20 of the engine rotation tool 10. The receiving recess 20 of the engine rotation tool 10 has a generally square shape to mate with the protrusion 36. With a torquing motion of the socket wrench handle 30, a mechanical advantage is provided by the handle to the accessory drive pulley bolt 26. The torque is transmitted from the handle 30 to the accessory drive pulley bolt 26 through the engine rotation tool 10. It is also possible that, instead of a socket wrench, the engine rotation tool 10 can be operated with a non-impacting tool that transmits torque. Further, the accessory drive pulley bolt 26 may be any other bolt that, when torque is applied, will cause the crankshaft to rotate.

Defining the female socket recess 22 of the socket body 12 is a bolt-torquing portion 38, and on the first end 16 of the engine rotation tool 10 and defining the receiving recess 20 of the socket body is a driving portion 40. Torque is applied by the engagement of the protrusion 36 with the driving portion 40 of the socket body 12. When torque is applied by the wrench handle 30 through the protrusion 36 to the driving portion 40, a shear pin 42 transmits the torque from the driving portion 40 to the bolt-torquing portion 38 of the socket body 12. The shear pin 42 is shown passing entirely through the driving portion 40 and the bolt-torquing portion 38 such that there are two effective shear planes passing through the shear pin 42. However, the shear pin 42 may also pass only through one side of the driving portion 40 and the bolt-torquing portion 38, such that there is only one effective shear plane passing through the shear pin 42.

To form the socket body 12, the driving portion 40 is engaged with the bolt torquing portion 38. In the engine rotation tool of FIG. 1, the driving portion 40 is generally cylindrical and has the receiving recess 20 at a first end 44 of the driving portion, and an engaging protrusion 46 at a second end 48 of the driving portion. The engaging protrusion 46 of the driving portion 40 may be generally cylindrical and be received in a generally cylindrical interior receiving recess 50 of the bolt-torquing portion 38. The interior receiving recess 50 is disposed at a first end 52 of the bolt-torquing portion 38, and the female socket recess 22 is disposed at a second end 54 of the bolt-torquing portion. In the absence of a shear pin 42 coupling the driving portion 40 and the bolt-torquing portion 38, the shape of the engaging protrusion 46 and the shape of the interior receiving recess 50 allows the relative torquing motion of the driving portion 40 with respect to the bolt-torquing portion 38. That is, it is the shear pin 42 that permits the driving portion 40 to apply a torquing force on the bolt-torquing portion 38.

The shear pin 42 may have any shape that mechanically couples the driving portion 40 of the socket body 12 to the bolt-torquing portion 38 of the socket body. Example shear pins 42 may be generally cylindrical, however other shapes are possible. The shear pin 42 may be oriented generally perpendicular to the axis A of the socket body 12, and may extend fully through the driving portion 40 and the bolt-torquing portion 38, or may extend through only one side of the driving portion 40 and the bolt-torquing portion 38. The shear pin 42 may be retained in the body 12 with a spring clip 55 that prevents each end of the shear pin from exiting a shear pin channel 57 in the body 12. The spring clip 55 may be generally annular and extend substantially around the exterior surface 14 of the body 12, and may be received in a groove 58 on the exterior surface 14 of the body 12. The spring clip 55 is positioned over the entrances of the shear pin channel 57.

When the shear pin 42 fails, for example by shearing, the torque is no longer transmitted from the driving portion 40 to the bolt-torquing portion 38, and therefore, torque is not applied to the accessory drive pulley bolt 26. The shear pin 42 of the engine rotation tool 10 is configured to fail before over-torquing of the accessory drive pulley bolt 26 can occur, or before loosening of a properly torque drive pulley bolt 26 can occur. If the amount of force to over-torque the accessory drive pulley bolt 26 and cause damage to the engine is known, the engine rotation tool 10 can be configured to fail at the shear pin 42 when a smaller, predetermined torquing force is applied, so that the amount of force to over-torque the accessory drive pulley bolt 26 may not be achieved. In this way, the engine rotation tool 10 limits the torque that reaches the accessory drive pulley bolt 26. The torque that reaches the accessory drive pulley bolt 26 is limited by the shear strength of the shear pin 42. The failure of the shear pin 42 is a sign to the user of the engine rotation tool 10 that the accessory drive pulley bolt 26 may be close to being over-torqued or loosened.

The socket wrench 30 may be of the ratchet type, which allows the accessory drive pulley bolt 26 to be tightened or loosened with a reciprocating motion of the hand-receiving portion 32, without the socket wrench 30 being removed and refitted to the bolt. A lever 56 on the socket head 34 switches the socket wrench 30 between tightening and loosening mode.

Figure 2:
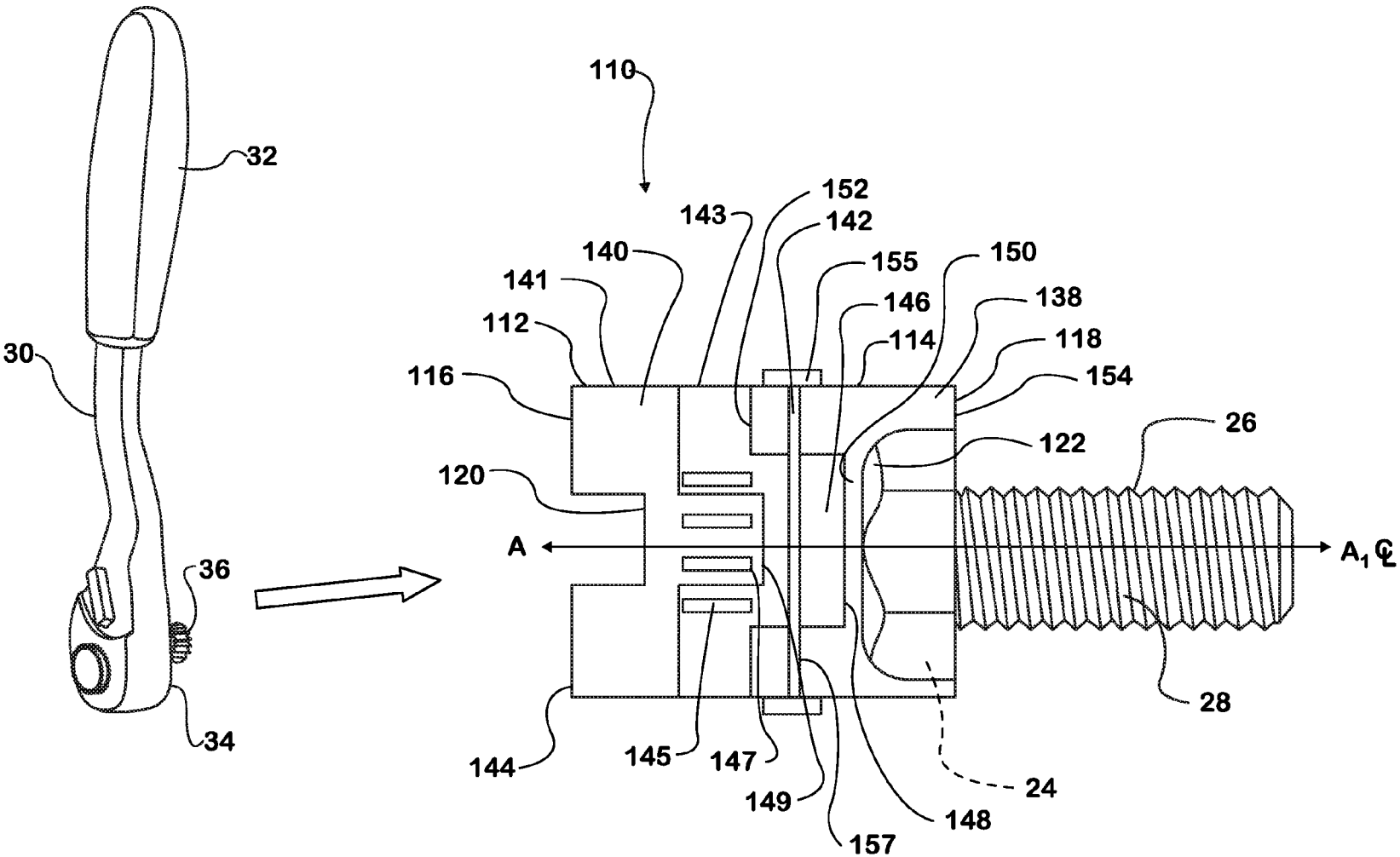
FIG. 2 is a schematic cross-section view of a second embodiment of torque limiting engine rotation tool.

Referring now to FIG. 2, a second embodiment of an engine rotation tool 110 includes a socket body 112 that is one-way ratcheting. The socket body 112 is generally cylindrical shaped and has a longitudinal axis A, an exterior surface 114 generally parallel with the longitudinal axis A, and a first end 116 and a second end 118 opposite of the first end. While the exterior surface 114 is shown generally parallel to the axis A, it is contemplated that the exterior surface may be curved or irregular-shaped.

A receiving recess 120 is disposed on axis A on the first end 116 of the socket body 112, and a female socket recess 122 is disposed on the axis A on the second end 118 of the socket body. The female socket recess 122 is configured to receive the accessory drive pulley center bolt 26.

Similar to the engine rotation tool 10, the receiving recess 120 of the engine rotation tool 110 is configured to receive the socket wrench handle 30 having the hand-receiving portion 32 and the socket head 34. The protrusion 36 extends from the socket head 34 and engages the receiving recess 120 of the engine rotation tool 110. The receiving recess 120 of the engine rotation tool 10 has a generally rectangular shape to mate with the protrusion 36. It is also possible that, instead of a socket wrench, the engine rotation tool 10 can be operated with a non-impacting tool that transmits torque. Further, the accessory drive pulley bolt 26 may be any other bolt that, when torque is applied, will cause the crankshaft to rotate.

Defining the female socket recess 122 of the socket body 112 is a bolt-torquing portion 138, and on the first end 116 of the engine rotation tool 110 and defining the receiving recess 120 of the socket body is a driving portion 140. Torque is applied by the engagement of the protrusion 36 with the driving portion 140. When torque is applied by the wrench handle 30 through the protrusion 36 to the driving portion 140, a shear pin 142 transmits the torque from the driving portion 140 to the bolt-torquing portion 138. The shear pin 142 is shown passing entirely through the driving portion 140 and the bolt-torquing portion 138 such that there are two effective shear planes passing through the shear pin 142. However, the shear pin 142 may also pass only through one side of the driving portion 140 and the bolt-torquing portion 138, such that there is only one effective shear plane passing through the shear pin 142.

To form the socket body 112, the driving portion 140 is engaged with the bolt-torquing portion 138. The driving portion 140 may include multiple components. In the embodiment of FIG. 2, the driving portion 140 includes an exterior portion 141 and an interior portion 143 that are coupled together with a ratchet 145 so that torque is applied only in one direction, for example only to loosen or only to tighten the bolt 26. The ratchet 145 may be selectively reversible, such that the torque limiting engine rotation tool 10 may be used to apply a directional torque in the selected direction and free wheel in the opposite direction. Specifically, there are four states. The torque limiting engine rotation tool 10 may drive in a first direction and free wheel in a second direction opposite to the first direction, or the torque limiting engine rotation tool 10 may drive in the second direction and free wheel in the first direction.

Both the exterior portion 141 and the interior portion 143 are generally cylindrical. The first end 144 of the exterior portion 141 includes the receiving recess 120, and opposite from the receiving recess on the axis A, the exterior portion 141 includes a first protrusion 147 that is engaged with a receiving recess 149 of the interior portion 143. Opposite from the receiving recess 149 on the axis A, the interior portion 143 includes the engaging protrusion 146 at the second end 148 of the driving portion 140. The engaging protrusion 146 of the driving portion 140 may be generally cylindrical and may be received in a generally cylindrical interior receiving recess 150 of the bolt-torquing portion 138.

The interior receiving recess 150 of the bolt-torquing portion 138 is disposed at a first end 152 of the bolt-torquing portion 138, and the female socket recess 122 is disposed at a second end 154 of the bolt-torquing portion along axis A. In the absence of a functioning shear pin 142 coupling the driving portion 140 and the bolt-torquing portion 138, the interior receiving recess 150 allows the relative torquing motion of the driving portion 140 with respect to the bolt-torquing portion 138. The shear pin 142 couples the driving portion 140 to apply a torquing force on the bolt-torquing portion 138.

Similar to the shear pin 42, the shear pin 142 may have any shape that mechanically couples the driving portion 140 of the socket body 112 to the bolt-torquing portion 138 of the socket body. The shear pin 142 may be received in a channel 157 and be retained by a spring clip 155 that extends substantially around the body 12.

When the shear pin 142 fails, for example by shearing, the torque is no longer transmitted from the driving portion 140 to the bolt-torquing portion 138, and therefore, torque is not applied to the accessory drive pulley bolt 26. The shear pin 142 is configured to fail before over-torquing or loosening of the accessory drive pulley bolt 26 can occur. In this way, the engine rotation tool 110 limits the torque that reaches the accessory drive pulley bolt 26.

With the torque limiting engine rotation tool 10, 110, the time it takes for a technician to rotate an engine is reduced, and the likelihood of over-torquing the accessory pulley bolt is reduced. The torque limiting engine rotation tool 10, 110 is a simple tool that may be easily repaired with a new shear pin 42, 142, and may have a low cost to manufacture.

While specific embodiments have been described in detail in the foregoing detailed description and illustrated in the accompanying drawings, those with ordinary skill in the art will appreciate that various permutations are possible without departing from the teachings disclosed herein. Accordingly, the particular arrangements disclosed are meant to be illustrative only and not limiting as to the scope of the invention, which is to be given the full breadth of the appended claims and any and all equivalents thereof. Other advantages to the Torque Limiting Engine Rotation Tool may also be inherent, without having been described above.

What is claimed is:

1. A torque limiting engine rotation tool for rotating a crankshaft of an engine, the torque limiting engine rotation tool configured to be operated with a socket wrench or non-impacting tool, and to engage an accessory drive pulley bolt or other bolt that will cause the crankshaft to rotate, the torque limiting engine rotation tool comprising:

a socket body having a driving portion coupled to a bolt-torquing portion with a shear pin;

a receiving recess defined by the driving portion and configured to receive the socket wrench or non-impacting tool; and a female socket recess defined by the bolt-torquing portion and configured to engage the bolt; wherein the amount of torque applied by the socket wrench or non-impacting tool to the bolt through the socket body is limited by the shear strength of the shear pin, said shear pin is retained in the socket body with a spring clip.

2. The torque limiting engine rotation tool of claim 1 wherein the shear pin is configured to fail at a predetermined amount of torque at the socket body.

3. The torque limiting engine rotation tool of claim 1 wherein the socket body is generally cylindrical in shape with a longitudinal axis A.

4. The torque limiting engine rotation tool of claim 3 wherein the shear pin is generally perpendicular to the axis A and extends entirely through the driving portion and the bolt-torquing portion.

5. The torque limiting engine rotation tool of claim 3 wherein the shear pin is generally perpendicular to the axis A and extends through one side of the driving portion and the bolt-torquing portion.

6. The torque limiting engine rotation tool of claim 3 wherein the driving portion includes the receiving recess at a first end, and an engaging protrusion at a second end, wherein the first end and the second end are generally perpendicular to the axis A.

7. The torque limiting engine rotation tool of claim 6 wherein the bolt-torquing portion includes the female socket recess at a second end, and a interior receiving recess at a first end, wherein the first end and the second end are generally perpendicular to the axis A, wherein the interior receiving recess receives the engaging protrusion of the driving portion.

8. The torque limiting engine rotation tool of claim 7 wherein the engaging protrusion is coupled to the interior receiving recess with the shear pin to transmit torque from the driving portion to the bolt-torquing portion.

9. The torque limiting engine rotation tool of claim 8 wherein when the shear pin fails, the engaging protrusion does not transmit torque from the driving portion to the bolt-torquing portion.

10. The torque limiting engine rotation tool of claim 1 wherein the driving portion comprises at least two portions.

11. The torque limiting engine rotation tool of claim 1 wherein the driving portion comprises an exterior portion defining the receiving recess, and an interior portion including an engaging protrusion that is configured to engage the bolt-torquing portion.

12. The torque limiting engine rotation tool of claim 11 wherein the driving portion further comprises a ratchet that couples the exterior portion and the interior portion together.

13. The torque limiting engine rotation tool of claim 12 wherein the ratchet is selectively reversible.

14. A torque limiting engine rotation tool for rotating a crankshaft of an engine, the torque limiting engine rotation tool configured to be operated with a socket wrench or non-impacting tool and to engage an accessory drive pulley bolt or other bolt that will cause the crankshaft to rotate, the torque limiting engine rotation tool comprising:

a socket body having a driving portion engaged with a bolt-torquing portion, wherein the socket body has a longitudinal axis; a receiving recess defined by the driving portion and configured to receive the socket wrench or non-impacting tool; a shear pin disposed generally perpendicular to the longitudinal axis and extending through at least one side of the driving portion and the bolt-torquing portion; and a female socket recess defined by the bolt-torquing portion and configured to engage the bolt; wherein when torque is applied by the socket wrench or non-impacting tool to the driving portion of the socket body, the shear pin transmits the torque from the driving portion to the bolt-torquing portion, wherein if the shear pin fails, torque is not transmitted from the driving portion to the bolt-torquing portion, said shear pin is retained in the socket body with a spring clip.

15. The torque limiting engine rotation tool of claim 14 wherein the shear pin extends entirely through the driving portion and the bolt-torquing portion.

16. The torque limiting engine rotation tool of claim 14 wherein the driving portion includes the receiving recess at a first end, and an engaging protrusion at a second end, wherein the first end and the second end are generally perpendicular to the axis A.

17. The torque limiting engine rotation tool of claim 16 wherein the bolt torquing portion includes the female socket recess at a second end, and a interior receiving recess at a first end, wherein the first end and the second end are generally perpendicular to the axis A, wherein the interior receiving recess receives the engaging protrusion of the driving portion.

18. The torque limiting engine rotation tool of claim 17 wherein the engaging protrusion is coupled to the interior receiving recess with the shear pin to transmit torque from the driving portion to the bolt-torquing portion.

19. The torque limiting engine rotation tool of claim 14 wherein the driving portion comprises an exterior portion defining the receiving recess, and an interior portion including an engaging protrusion that is configured to engage the bolt-torquing portion.

20. The torque limiting engine rotation tool of claim 19 wherein the driving portion further comprises a ratchet that couples the exterior portion and the interior portion together.

21. The torque limiting engine rotation tool of claim 20 wherein the ratchet is selectively reversible.

* * * * *